US006624790B1

(12) United States Patent
Wong et al.

(10) Patent No.: US 6,624,790 B1
(45) Date of Patent: Sep. 23, 2003

(54) INTEGRATED DUAL-BAND PRINTED MONOPOLE ANTENNA

(75) Inventors: Kin Lu Wong, Kaohsiung (TW); Yen Liang Kuo, Tainan (TW)

(73) Assignee: Accton Technology Corporation, Taiwan (CN)

( * ) Notice: Subject to any disclaimer, the term of this patent is extended or adjusted under 35 U.S.C. 154(b) by 0 days.

(21) Appl. No.: 10/140,166

(22) Filed: May 8, 2002

(51) Int. Cl.[7] ..... H01Q 1/38

(52) U.S. Cl. ..... 343/702; 343/795; 343/829; 343/846

(58) Field of Search ..... 343/700 MS, 702, 343/795, 797, 829, 846, 841, 848; H01Q 1/38, 13/08

(56) References Cited

U.S. PATENT DOCUMENTS 5,007,105 A * 4/1991 Kudoh et al. ..... 455/344
5,990,838 A 11/1999 Burns et al. ..... 343/702
6,344,823 B1 * 2/2002 Deng ..... 343/700 MS
6,535,167 B2 * 3/2003 Masuda et al. ..... 343/700 MS
6,549,167 B1 * 4/2003 Yoon ..... 343/700 MS
6,549,170 B1 * 4/2003 Kuo et al. ..... 343/702

* cited by examiner

*Primary Examiner*—Tho Phan

(57) ABSTRACT

An integrated dual-band printed monopole antenna includes a microwave substrate, a first dual-band monopole antenna, a second dual-band monopole antenna and a ground plane. The substrate has a first surface and a second surface. The first and the second antennas are disposed on the first surface of the substrate and each is excited by a first or a second microstrip feeding line through a first or a second feeding port. The first and the second dual-band monopole antennas both include a first horizontal radiating metallic line, a second horizontal radiating metallic line and a vertical radiating metallic line. The vertical radiating metallic line has a feeding point in one end connecting to the first or the second microstrip feeding line. The ground plane is disposed on the second surface of the substrate, wherein the ground plane has a main ground plane and a protruded ground plane extending between the first and the second antenna.

9 Claims, 8 Drawing Sheets

INTEGRATED DUAL-BAND PRINTED MONOPOLE ANTENNA

BACKGROUND OF THE INVENTION

1. Field of the Invention

The present invention relates to an antenna system, and more particularly to an integrated dual-band printed monopole antenna for WLAN (wireless local area network) application.

2. Description of the Related Art

With the prosperous development in wireless communications, the users also become very demanding in communication quality. It is required that the communication products be thinner, lighter, shorter and smaller, and stable communication quality is also a big concern. However, the multipath fading effect significantly reduces the communication quality of the system. Accordingly, it is necessary to employ antenna diversity to combat the multipath fading effect in wireless communication system.

Generally speaking, conventional antenna diversity can be accomplished in the form of frequency diversity, time diversity, or spatial diversity. In frequency diversity, the system switches between frequencies to combat multipath fading effect. In time diversity systems, the signal is transmitted or received at two different times to combat multipath fading effect. In spatial diversity systems, two or more antennas are placed at physically different locations to combat multipath fading effect.

U.S. Pat. No. 5,990,838, issued to Burns et al. on Nov. 23, 1999 entitled "Dual Orthogonal Monopole Antenna System," discloses a spatial diversity antenna system having a pair of monopole antennas respectively disposed on the top and bottom surfaces of the printed circuit board which has a first and a second dielectric layers, a conducting ground plane disposed between the first and second dielectric layers, wherein the pair of antennas are mutually orthogonal, and a feeding circuit is coupled to the pair of antennas for connecting to a principal system.

Although U.S. Pat. No. 5,990,838 has provided an antenna system of spatial diversity to improve the multipath fading effect in wireless communication system, the system can only be used in single-band operation and it fails to obtain optimal isolation between the two feeding ports of the antenna system (its $S_{21}>-20$ dB). Furthermore, U.S. Pat. No. 5,990,838 needs to use multilayer printed substrate, which requires a complex structure and high fabrication cost.

Therefore, it is necessary to provide an antenna system for effectively solving the problems of conventional art mentioned above, so as to be used in dual bands, e.g. 2.4 GHz and 5.2 GHz, wireless local area network, to obtain high isolation ($S_2<-20$ dB) and to combat the multipath fading effect in wireless communication system.

SUMMARY OF THE INVENTION

It is a primary object of the present invention to provide an integrated dual-band printed monopole antenna which can be operated in dual bands for use in the 2.4 GHz and 5.2 GHz WLAN operation.

It is a another object of the present invention to provide an integrated dual-band printed monopole antenna having high isolation ($S_{21}$) between the two feeding ports of the antenna to combat the multipath fading effect in wireless communication system.

It is still another object of the present invention to provide an integrated dual-band printed monopole antenna which has a simple structure and can be fabricated at lower cost.

In order to achieve the above objects, the present invention provides an integrated dual-band printed monopole antenna which comprises: a microwave substrate, a first dual-band monopole antenna, a second dual-band monopole antenna and a ground plane. The substrate has a first surface and a second surface.

The first and the second dual-band monopole antennas are disposed on the first surface of the substrate and are mutually orthogonal. Each of the first and the second dual-band monopole antennas is excited by a microstrip feeding line through a feeding port. The first and the second dual-band monopole antennas both include a first horizontal radiating metallic line, a second horizontal radiating metallic line and a vertical radiating metallic line. The first horizontal radiating metallic line is connected to one end of the vertical radiating metallic line opposite to the feeding port, the second horizontal radiating metallic line is connected to the vertical radiating metallic line at the position different from where the first horizontal radiating metallic line is connected to, and the other ends (free ends) of the two horizontal radiating metallic lines extend outwards in the same direction, whereby the antenna is formed as an F shape. For each of the first and the second dual-band monopole antennas, the path from the feeding port through the vertical radiating metallic line to the free end of the first horizontal radiating metallic line forms the first resonant path in operation and determines the first (the lower) operating frequency of the dual-band monopole antenna. In addition, the path from the feeding port through the vertical radiating metallic line to the free end of the second horizontal radiating metallic line forms the second resonant path in operation and determines the second (the higher) operating frequency of the antenna. Therefore, the antenna can be operated in dual bands.

The ground plane is disposed on the second surface of the substrate, wherein the ground plane has a main ground plane and a protruded ground plane extending between the first and the second antenna. The main metallic ground plane is rectangular or substantially rectangular shape, wherein two adjacent corners thereof are respectively cut off a 45° edge portion, and the lengths of the two cut edge portions are the same. The first and the second monopole antennas are dispose respectively at an angle ($\alpha$) orthogonal (90°) to the edge of the main metallic ground plane and oriented symmetrically with respect to the protruded ground plane so as that the protruded metallic plane can effectively reduce the coupling between the two dual-band monopole antennas to obtain good isolation and impedance matching.

DETAILED DESCRIPTION OF PREFERRED EMBODIMENTS

Figure 1:
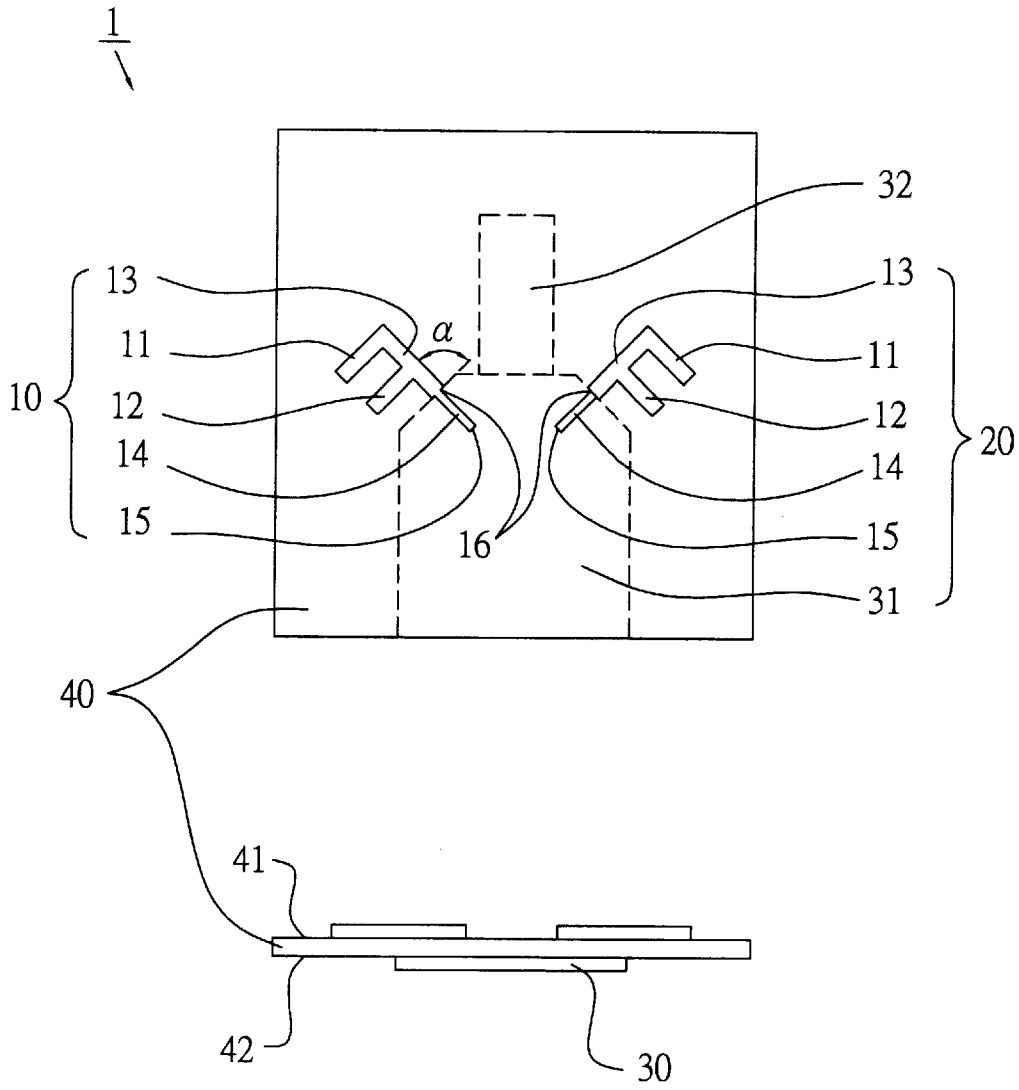
FIG. 1 is a structure diagram of an integrated dual-band printed monopole antenna of the present invention.

While the present invention is susceptible of embodiment in various forms, there is a presently preferred embodiment shown in the drawings and will hereinafter be described with the understanding that the present disclosure is to be considered as an exemplification of the invention and is not intended to limit the invention to the specific embodiment illustrated.

FIG. 1 shows that an integrated dual-band printed monopole antenna 1 mainly comprising a microwave substrate 40, a first dual-band monopole antenna 10, a second dual-band monopole antenna 20, and a ground plan 30. The microwave substrate 40 has a first surface 41 (top surface) and a second surface 42 (bottom surface), wherein the first dual-band monopole antenna 10 and the second dual-band monopole antenna 20 are disposed on the first surface 41 of the microwave substrate 40, and are mutually orthogonal, and the ground plane 30 is disposed on the second surface 42 of the microwave substrate 40. The ground plane 30 includes a main ground plane 31 and a protruded ground plane 32 extending between the first dual-band monopole antenna 10 and second dual-band monopole antenna 20.

The microwave substrate 40 is generally a printed circuit board manufactured by BT (bismaleimide-triazine) or FR4 (fiberglass reinforced epoxy resin), or a flexible film substrate made of polyimide in accordance with the present invention. The first dual-band monopole antenna 10 and the second dual-band monopole antenna 20 are printed on the first surface 41 of the microwave substrate 40, and the ground plane 30 is printed on the second surface 42 of the microwave substrate 40.

The first dual-band monopole antenna 10 and the second dual-band monopole antenna 20 in accordance with the present invention substantially have the same structure. Referring to FIG. 1, the dual-band monopole antenna 10 and 20 mainly comprise: a first horizontal radiating metallic line 11, a second horizontal radiating metallic line 12, a vertical radiating metallic line 13, and a feeding point 16. The microwave substrate 40 includes a microstrip feeding metallic line 14 on the first surface 41. The first and the second horizontal radiating metallic line 11 and 12 and the vertical radiating metallic line 13 are printed on the first surface 41 of the substrate, wherein the vertical radiating metallic line 13 is substantially perpendicular to the first horizontal radiating metallic line 11 and the second horizontal radiating metallic line 12. The feeding point 16 is disposed on the vertical radiating metallic line 13 for connecting the microstrip feeding line 14 to the vertical radiating metallic line 13 so as to transmit signals. In this embodiment, the first horizontal radiating metallic line 11 is connected to one end of the vertical radiating metallic line 13 or the vicinity thereof opposite to the feeding point 16, while the second horizontal radiating metallic line 12 is connected to the vertical radiating metallic line 13 at the position different from where the first horizontal radiating metallic line 11 is connected to, wherein the other ends (free ends) of the two horizontal radiating metallic lines 11 and 12 extend outwards in the same direction and thus the antennas 10 and 20 are formed as an F shape. In the embodiment as shown in FIG. 1, the F shape dual-band monopole antennas 10 and 20 are disposed back to back.

The path from the feeding point 16 through the vertical radiating metallic line 13 to the free end of the first horizontal radiating metallic line 11 forms the first resonant path of the dual-band monopole antennas 10 and 20 in operation and determines the first (the lower) operating frequency of the antennas 10 and 20. In addition, the path from the feeding point 16 through the vertical radiating metallic line 13 to the free end of the second horizontal radiating metallic line 12 forms the second resonant path of the antennas 10 and 20 in operation and determines the second (the higher) operating frequency of the antennas 10 and 20.

The main ground plane 31 is preferably rectangular or substantially rectangular, and the protruded metallic ground plane 32 is also rectangular or substantially rectangular. In addition, in order to dispose both the dual-band monopole antennas 10 and 20 respectively at an angle ($\alpha$) orthogonal (90°) to the edge of the main metallic ground plane 31, the two corners of the main metallic ground plane 31 are cut off a 45° section, and the radiating metallic lines of the monopole antennas 10 and 20 are also disposed orthogonal to the edges of the corners.

The first and the second dual-band monopole antennas 10 and 20 are excited respectively at a feeding port 15 through a first microstrip feeding line 14, wherein the first microstrip feeding line 14 is preferably a 50-Ω microstrip line. The first and the second monopole antennas 10 and 20 have the same structure, same size and they are oriented symmetrically with respect to the protruded ground plane 32. The protruded metallic plane 32 can effectively reduce the coupling between the two dual-band monopole antennas. An optimal isolation ($S_{21}$) can be obtained so as to significantly reduce the mutual coupling between the two dual-band monopole antennas, and the multipath fading effecting of the wireless communicating system can be reduced.

Figure 2:
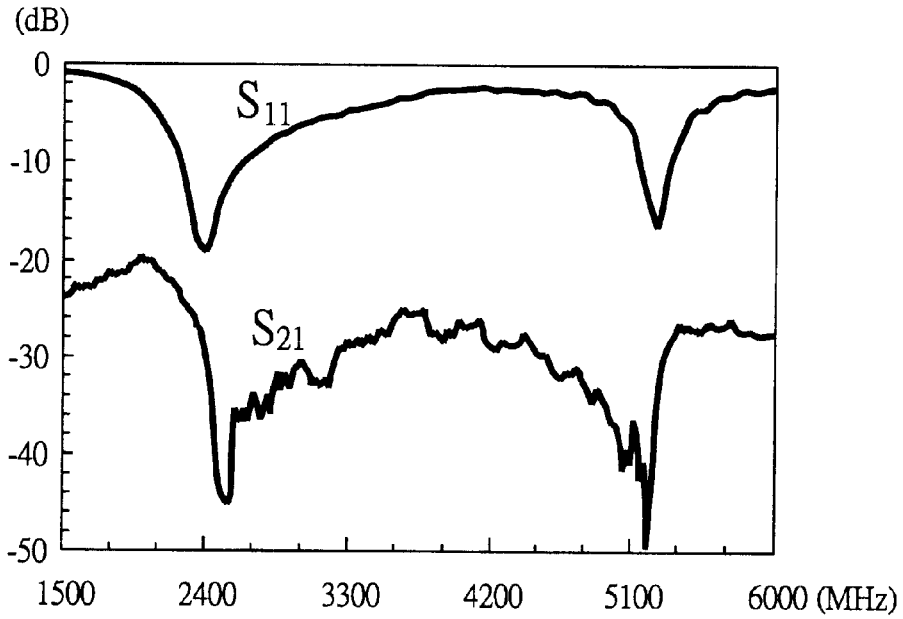
FIG. 2 is the experimental results of reflection coefficient ($S_{11}$) and isolation ($S_{21}$) in accordance with an embodiment of the present invention.
Figure 3:
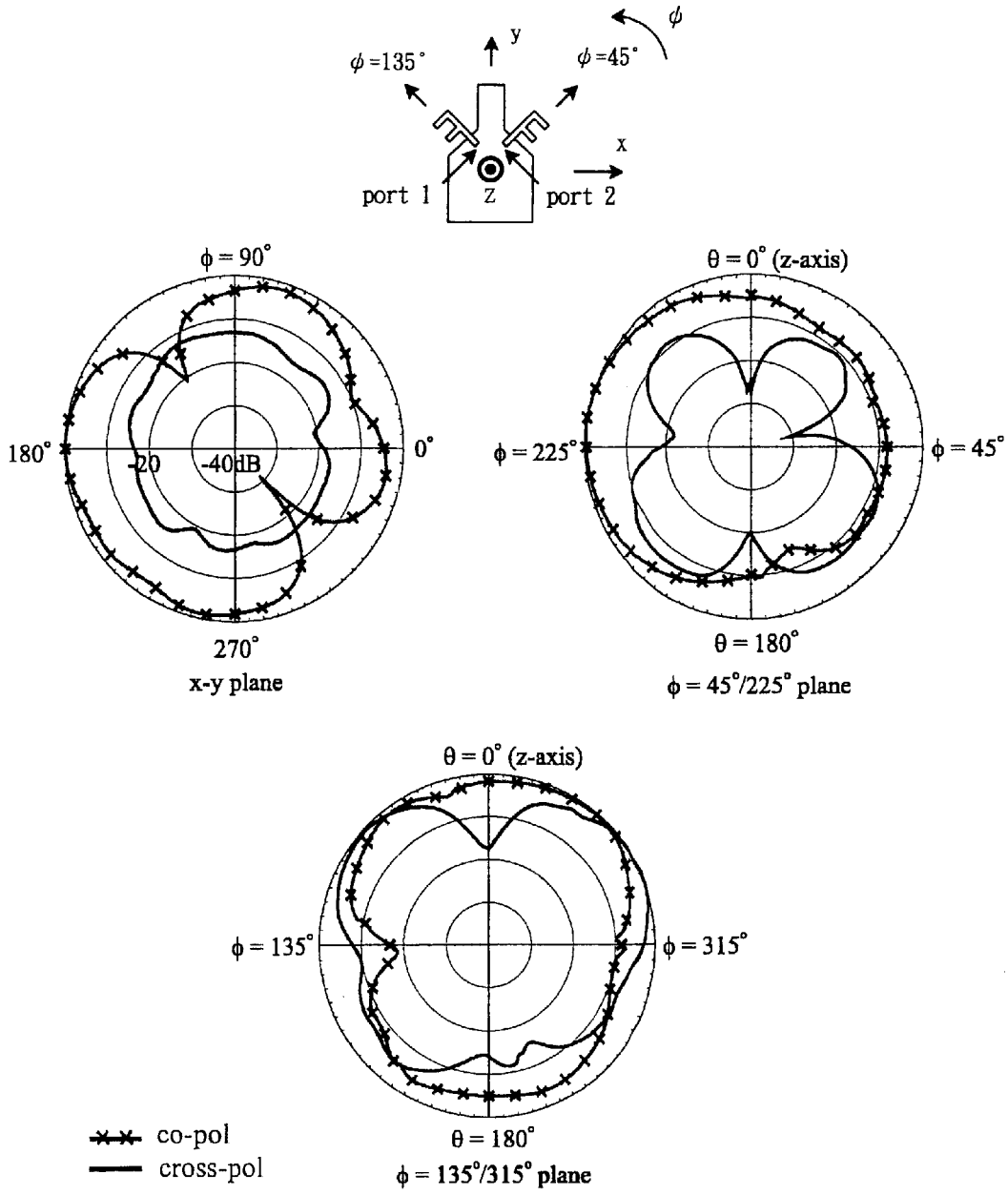
FIG. 3 is the experimental result of the radiation pattern of the first feeding port of the antenna at 2450 MHz in accordance with an embodiment of the present invention.
Figure 4:
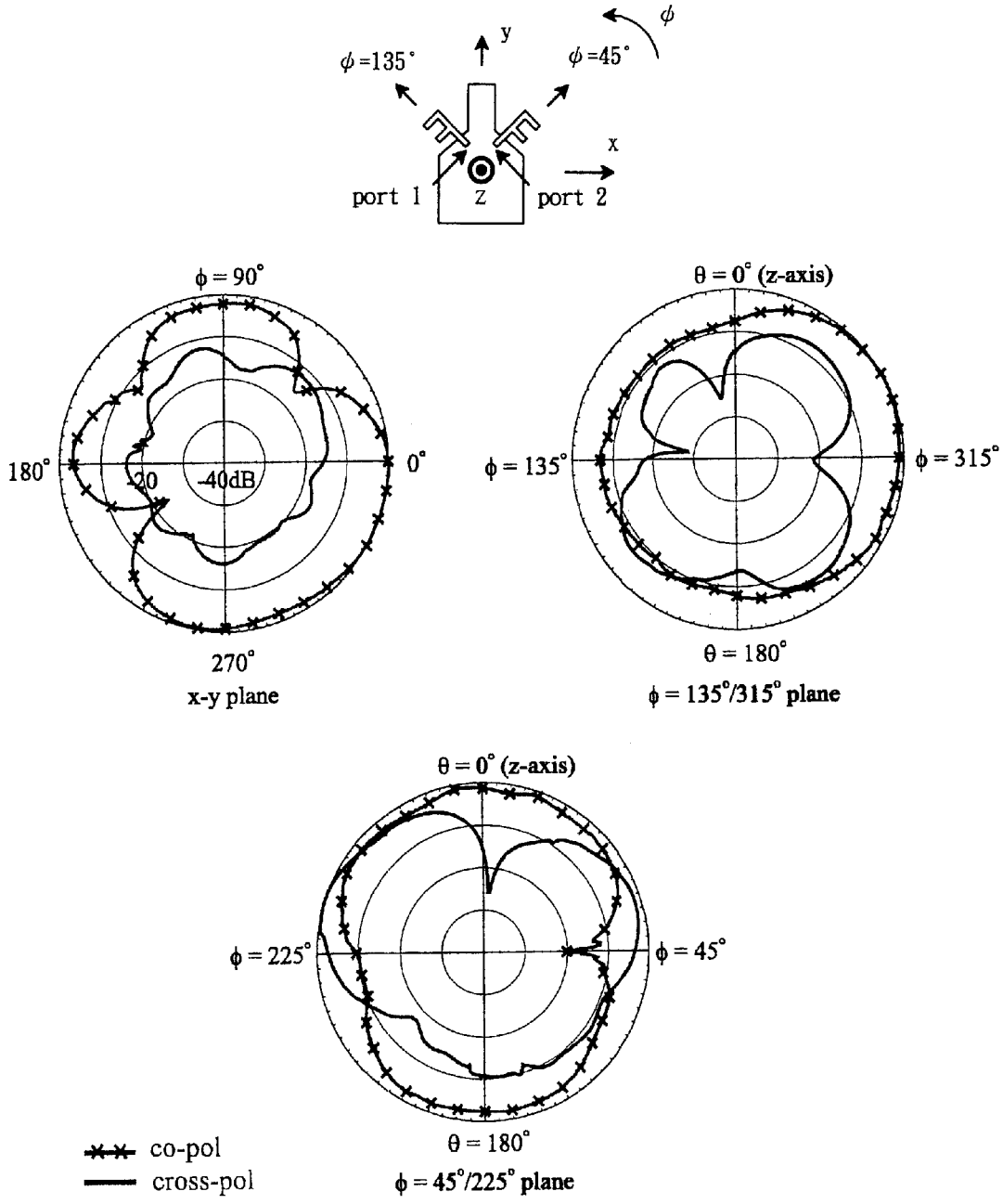
FIG. 4 is the experimental result of the radiation pattern of the second feeding port of the antenna at 2450 MHz in accordance with an embodiment of the present invention.
Figure 5:
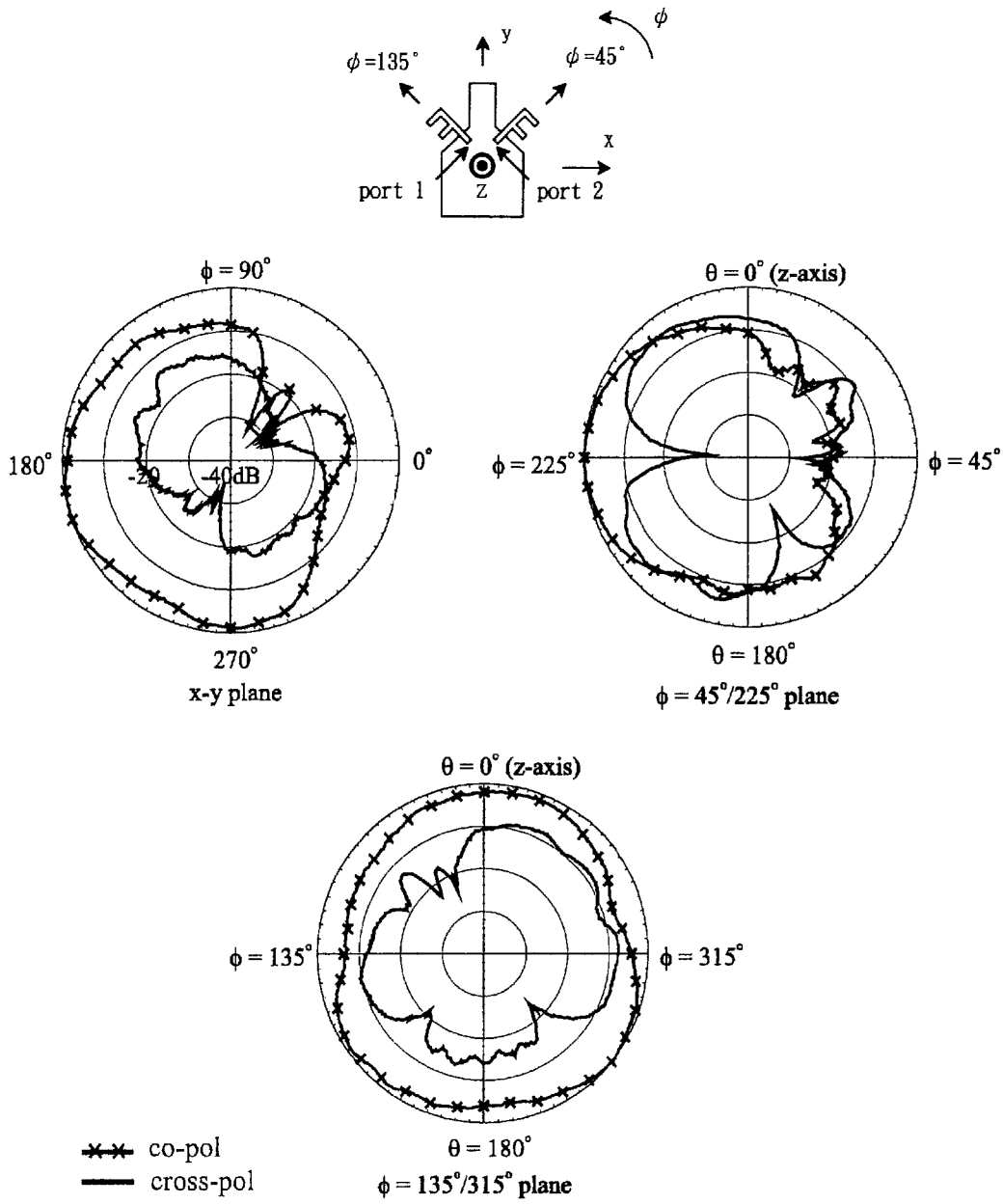
FIG. 5 is the experimental result of the radiation pattern of the first feeding port of the antenna at 5250 MHz in accordance with an embodiment of the present invention.
Figure 6:
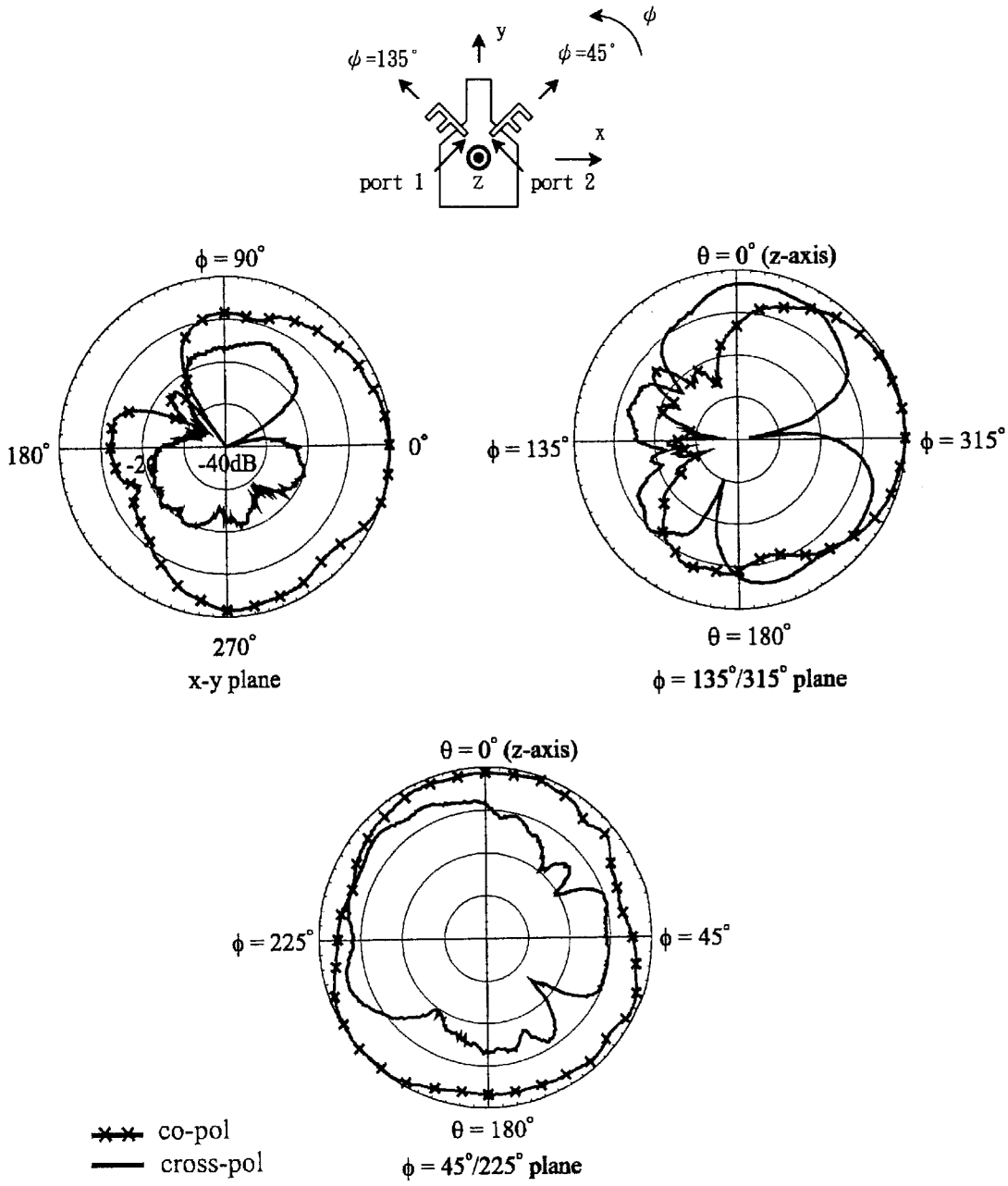
FIG. 6 is the experimental result of the radiation pattern of the second feeding port of the antenna at 5250 MHz in accordance with an embodiment of the present invention.

In accordance with the present invention, the measured results of the integrated dual-polarized printed monopole antenna 1 are shown in FIG. 2 to FIG. 8. The measured results of the reflection coefficient $S_{11}$ and isolation $S_{21}$ of the present antenna are shown in FIG. 2. As shown in FIG. 2, in the 2.4 GHz band (2400–2484 MHz) and 5.2 GHz band (5150–5350 MHz) for WLAN application, the reflection coefficient of all frequencies is less than −10 dB, indicating the impedance matching being greatly enhanced, and the isolation of both feeding ports is less than −28 dB, thereby providing better isolation.

Figure 7:
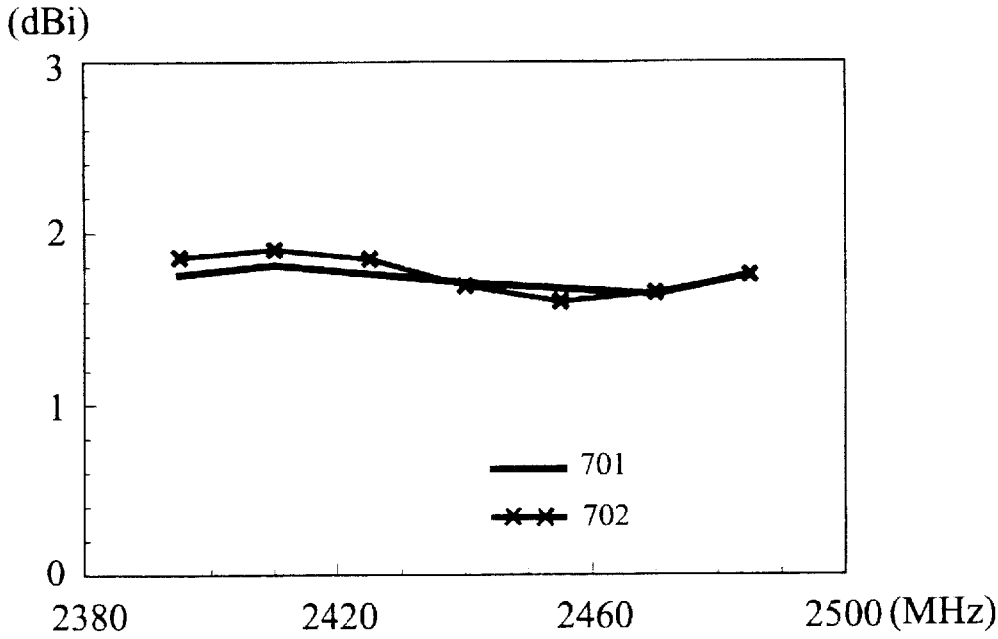
FIG. 7 is a diagram of the measured results showing the antenna gain of the dual-band monopole antenna in the 2.4 GHz band for WLAN operation in accordance with an embodiment of the present invention.
Figure 8:
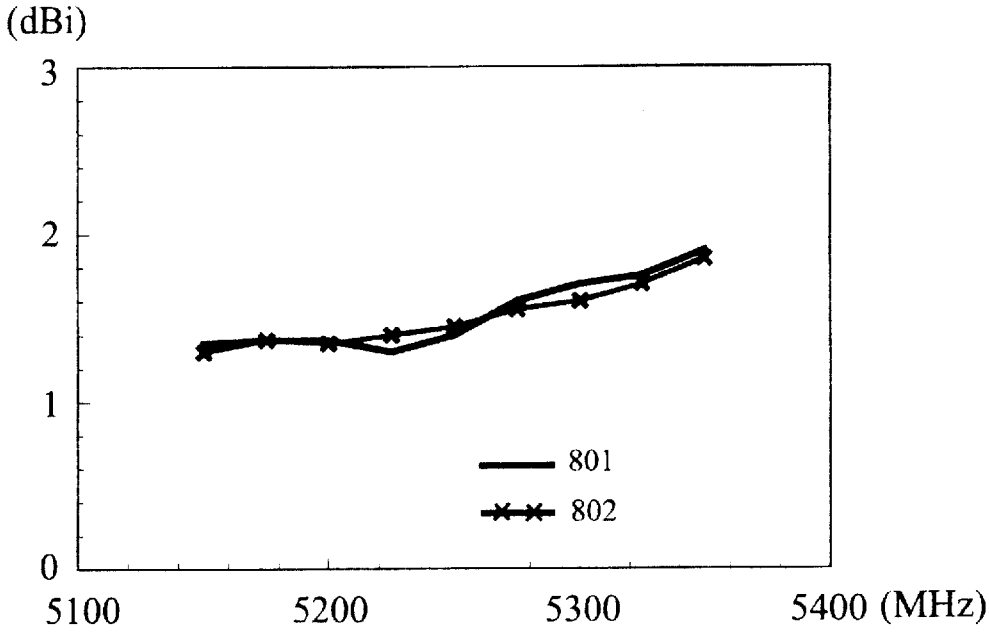
FIG. 8 is a diagram of the measured results showing the antenna gain of the dual-band monopole antenna in the 5.2 GHz band for WLAN operation in accordance with an embodiment of the present invention.

FIG. 3 to FIG. 6 are the measured radiation pattern results of the first and second feeding ports at 2450 MHz and 5250 MHz; the radiation patterns of both feeding ports are symmetric observed from the above results, which together makes the proposed antenna with a wide radiation coverage. FIG. 7 and FIG. 8 show the measured antenna gain results of the present antenna operating in the 2450 MHz band and 5250 MHz band, which reveal that good antenna gain is obtained.

Figure 9A:
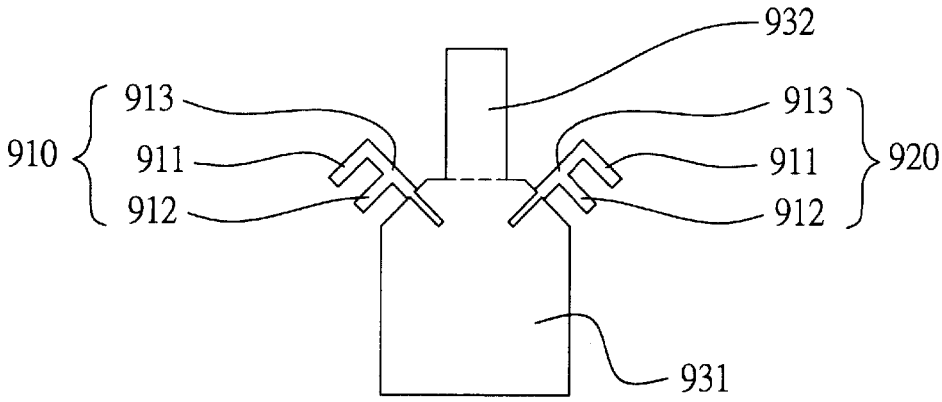
FIG. 9*a* through FIG. 9*b* are structure diagrams of dual-band printed monopole antennas in accordance with other embodiments of the present invention.
Figure 9B:
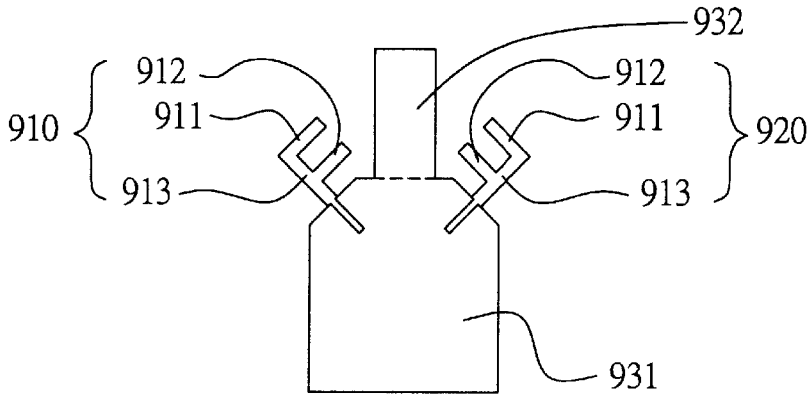

FIGS. 9(*a*) to 9(*b*) are the structure diagrams of the integrated dual-band monopole antenna of the present antenna employed in other embodiments. In the embodiment as shown in FIG. 9(*a*), the first horizontal radiating metallic lines 911, the second horizontal radiating metallic lines 912 and the vertical radiating metallic lines 913 of the F shape dual-band monopole antenna 910 and 920 can have different width. In the embodiment as shown in FIG. 9(*b*), the F shape dual-band monopole antenna 910 and 920 can be disposed face to face.

While the foregoing description and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure arrangement, proportions, materials, elements, and components and otherwise, used in the practice of the invention, which are particularly adapted to specific environments and operating requirements without departing from the principles of the present invention. The presently disclosed embodiments are therefore to be considered in all respects as illustrative and not restrictive, the scope of the invention being indicated by the appended claims and their legal equivalents, and not limited to be the foregoing description.

What is claimed is:

1. An integrated dual-band printed monopole antenna comprising:

a microwave substrate having a first surface and a second surface;

a first dual-band monopole antenna disposed on the first surface of the substrate and excited by a first microstrip feeding line through a first feeding port;

a second dual-band monopole antenna disposed on the first surface of the substrate and excited by a second microstrip feeding line through a second feeding port; and a ground plane disposed on the second surface of the substrate, the ground plane having a main ground plane and a protruded ground plane extending between the first and the second dual-band monopole antenna, wherein the first and the second dual-band monopole antennas comprise:

a first horizontal radiating metallic line;

second horizontal radiating metallic line; and a vertical radiating metallic line having a feeding point in one end connecting to the first or the second microstrip feeding lines.

2. The integrated dual-band printed monopole antenna as claimed in claim 1, wherein the first horizontal radiating metallic line is connected to one end of the vertical radiating metallic line opposite to the feeding point, the second horizontal radiating metallic line is connected to the vertical radiating metallic line at the position different from where the first horizontal radiating metallic line is connected to, and the other ends (free ends) of the two horizontal radiating metallic lines extend outwards in the same direction, whereby the antenna is formed as an F shape.

3. The integrated dual-band printed monopole antenna as claimed in claim 1, wherein the path from the feeding point through the vertical radiating metallic line to the free end of the first horizontal radiating metallic line forms the first resonant path of the antenna in operation and determines the first (the lower) operating frequency thereof.

4. The integrated dual-band printed monopole antenna as claimed in claim 1, wherein the path from the feeding point through the vertical radiating metallic line to the free end of the second horizontal radiating metallic line forms the second resonant path of the antenna in operation and determines the second (the higher) operating frequency thereof.

5. The integrated dual-band printed monopole antenna as claimed in claim 1, wherein the main ground plane is rectangular or substantially rectangular shape with two adjacent corners thereof respectively cut off a 45° edge portion.

6. The integrated dual-band printed monopole antenna as claimed in claim 1, wherein the first and the second microstrip feeding lines are 50-Ω microstrip lines.

7. The integrated dual-band printed monopole antenna as claimed in claim 1, wherein the first and the second monopole antennas are oriented symmetrically with respect to the protruded ground plane.

8. The integrated dual-band printed monopole antenna as claimed in claim 1, wherein the vertical radiating metallic line is substantially perpendicular to the first and second horizontal radiating metallic lines.

9. The integrated dual-band printed monopole antenna as claimed in claim 1, wherein the widths of the first and the second horizontal radiating metallic lines and the vertical radiating metallic lines can be different.

* * * * *